US005617922A

United States Patent [19]

Sundholm

[11] Patent Number: 5,617,922

[45] Date of Patent: Apr. 8, 1997

[54] INSTALLATION FOR FIGHTING FIRE WITH FIRST OR FIRST AND SECOND, DOOR ADJACENT SPRAY HEADS

[76] Inventor: Göran Sundholm, Ilmari Kiannon kuja 3, FIN-04310 Tuusula, Finland

[21] Appl. No.: 244,214

[22] PCT Filed: Dec. 3, 1992

[86] PCT No.: PCT/FI92/00330

§ 371 Date: May 20, 1994

§ 102(e) Date: May 20, 1994

[87] PCT Pub. No.: WO93/10861

PCT Pub. Date: Jun. 10, 1993

[30] Foreign Application Priority Data

Dec. 4, 1991 [FI] Finland ..... 915730

[51] Int. Cl.[6] ..... A62C 35/60

[52] U.S. Cl. ..... 169/16; 169/37; 169/38; 169/54

[58] Field of Search ..... 169/16, 54, 37, 169/38, 45, 46, 48

[56] References Cited

U.S. PATENT DOCUMENTS

| | | | |
|---|---|---|---|
| 1,887,747 | 11/1932 | Bills et al. | 169/37 |
| 2,586,797 | 2/1952 | Dunlop et al. | 169/48 |
| 3,791,450 | 2/1974 | Poitras | 169/37 |
| 3,884,304 | 5/1975 | Messerschmidt et al. | 169/16 |
| 3,990,518 | 11/1976 | Hemme . | |
| 4,043,397 | 8/1977 | Glowienke | 169/48 |
| 4,359,097 | 11/1982 | Claussen | 169/16 |

FOREIGN PATENT DOCUMENTS

| | | | |
|---|---|---|---|
| 8095/27 | 7/1927 | Australia | 169/54 |
| 010465 | 11/1981 | European Pat. Off. . | |
| 2665641 | 2/1992 | France | 169/54 |
| 533458 | 4/1930 | Germany | 169/48 |
| 13440901 | 7/1985 | Germany . | |
| 1474680 | 5/1977 | United Kingdom . | |
| 1810360 | 12/1981 | WIPO . | |
| 9310860 | 6/1993 | WIPO . | |

OTHER PUBLICATIONS

"Spray Application of Water", National Board of Fire Underwriters, Bulletin No. 92 Dec. 1939.

*Primary Examiner*—Gary C. Hoge
*Attorney, Agent, or Firm*—Ladas & Parry

[57] ABSTRACT

An installation for fighting a fire in a room having a door has a first spray head at a first location for spraying a fluid into the room and a second spray head at a second location adjacent the door for spraying a fluid as a barrier of for-like spray. A first release arrangement in the room activates the first spray head and a second release arrangement releases the second spray head but also receives fluid from the first spray head for distributing the fluid from the first and second spray heads when the first spray head is activated.

6 Claims, 4 Drawing Sheets

INSTALLATION FOR FIGHTING FIRE WITH FIRST OR FIRST AND SECOND, DOOR ADJACENT SPRAY HEADS

The present invention relates to an installation for fighting fire, in particular for comparatively small spaces, such as ship cabins and hotel rooms, with at least one releasing means to initiate a fire extinguishing process.

Especially by fires in passenger ships and hotels, the smoke gases present a serious danger; the majority of the victims usually die of smoke gas poisoning. With a fire set on, arsonists often leave the cabin door or the hotel room door open, with the desired result that both fire and especially smoke spread very rapidly, with a devastating effect.

The object of the invention is to provide a new installation for fighting fire, which is effective also in difficult situations as just mentioned.

The installation according to the invention is mainly characterized in that said releasing means is arranged to produce a barrier of a fog-like spray near the door of the respective space. The releasing means is generally either a spray head with a release ampoule or bulb, or a smoke detector producing a signal to activate one or several spray heads.

In a preferred embodiment of the invention at least one releasing spray head is arranged in the respective space and at least one spray head is arranged near the door of the space, and the releasing spray head is arranged to activate said at least one spray head near the door to produce a barrier of fog-like spray.

The spray head or heads near the door of a hotel room or ship cabin is preferably positioned outside the door and is preferably of a releasing type, as the spray head inside the room or cabin, and both spray heads are interconnected to upon release of either one of the spray heads activate the other spray head e.g. by distributing extinguishing liquid to it.

In a further preferred embodiment of the invention the releasing means is a spray head mounted on the wall above the door inside the room or the cabin and arranged to produce a barrier of fog-like spray inside the cabin or room, in front of the door. This embodiment needs in principle no co-operating spray head in the corridor and is easy to install, which is of significance especially when a fire-fighting installation shall be provided in a previously ready-built ship.

A barrier or curtain of fog-like spray near the door of a room or a cabin effectively prevents a fire and the smoke generated by it from spreading, and as the fire sucks in air along the floor, this air brings with it water-fog into the fire seat.

The spray heads, their individual nozzles and the mutual arrangement of the nozzles are preferably made according to what is presented in the international patent applications PCT/FI91/00060, PCT/FI92/00155 and PCT/FI92/00156, to produce a fog-like spray of a high operating pressure and having a good penetration power.

By a fog-like spray is meant a spray of small droplets having a diameter typically 30 to 100 microns and preferably set in a strong whirling motion. By a high operating pressure is here in general meant from about 50 bar up to about 300 bar, as compared to an operating pressure of generally 2 to 10 bar in conventional sprinkler installations, which produce a rain-like spray. It shall be noted, however, that the values given above are not absolute; definite limiting values are difficult to present.

The invention shall in the following be described in more detail, with reference to exemplifying preferred embodiments shown in the attached drawing.

Figure 1:
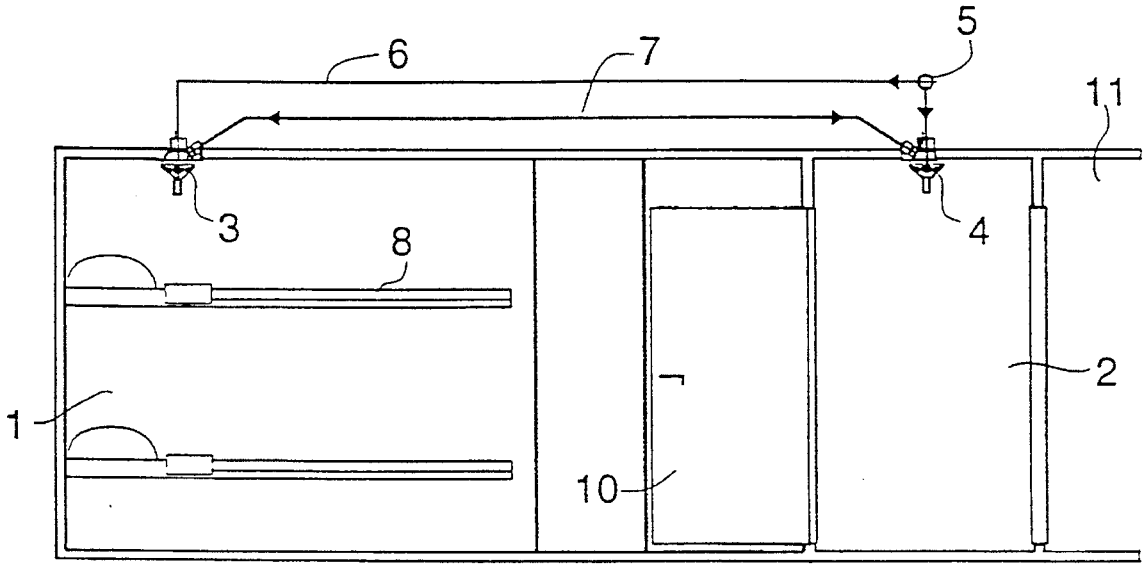
FIG. 1 shows a first preferred embodiment of the invention, in connection with a longitudinal section of a ship cabin and an adjacent corridor.
Figure 2:
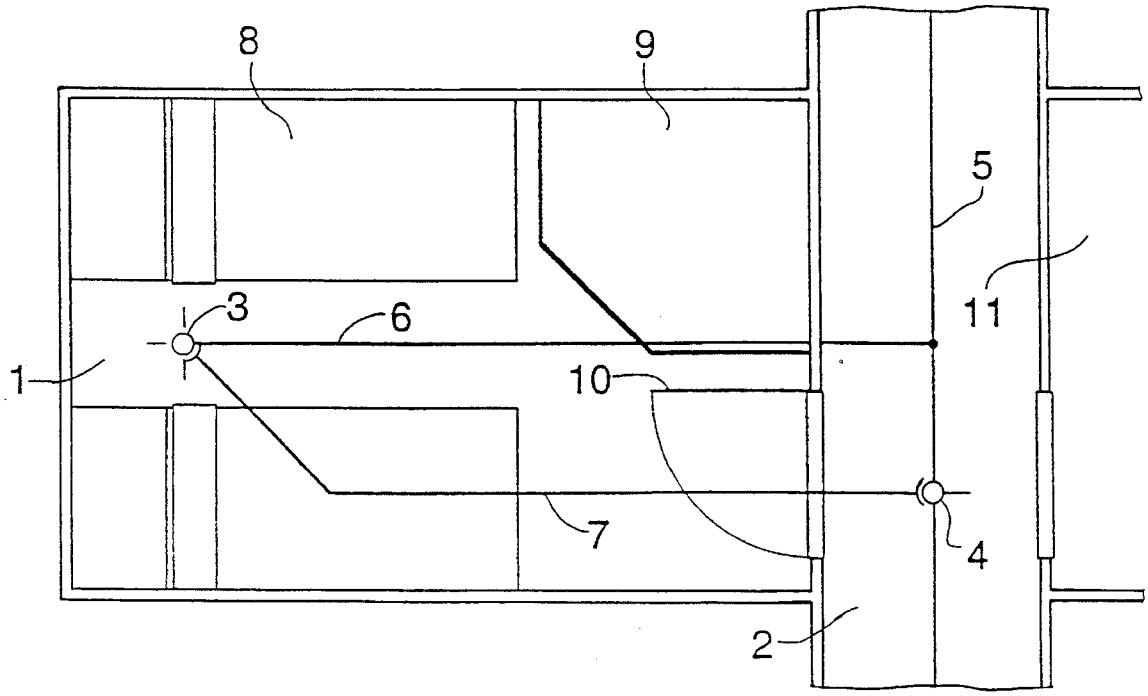
FIG. 2 shows the same cabin, as seen from above.

In FIGS. 1 and 2, the reference numeral 1 indicates a ship cabin, and an adjacent corridor is indicated by 2. A spray head arranged in the ceiling of the cabin 1 is indicated by 3 and a spray head arranged in the ceiling of the corridor 2 is indicated by 4.

The cabin spray head 3 is can be positioned near that end of the cabin, which is opposite to the cabin door, and the corridor spray head 4 is preferably positioned in the middle of the corridor, to serve two or maybe four cabins. A main feed line for extinguishing liquid, running along the corridor 2, is indicated by 5, a branch feed line to the cabin spray head 3 is indicated by 6 and a connection line between the cabin spray head 3 and the corridor spray head 4 is indicated by 7. The cabin beds are indicated by 8, the bathroom of the cabin is indicated by 9 and the cabin door by 10. A cabin on the opposite side of the corridor 2 is indicated by 11.

Figure 3:
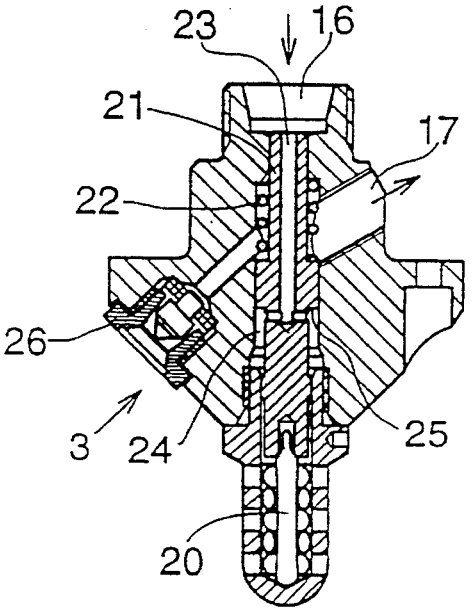
FIG. 3 shows a longitudinal section of a preferred embodiment of a releasing spray head useful in the arrangements of FIGS. 1 and 2.

A preferred embodiment of a cabin spray head 3 or a corridor spray head 4 is shown in FIG. 3. Reference numeral 16 indicates a liquid inlet. An outlet to the connection 7 to the corridor spray head 4 is indicated by 17. A release ampoule is indicated by 20.

The spray heads 3 and 4 are preferably of a structure described in the international patent application PCT/FI92/00060 (WO 92/15370), with an axially movable spindle 21 loaded by a spring 22 and having an axial channel 23 in connection with an annular space 24 with an axial, pressure compensating end surface 25 which makes it possible to utilize a drive pressure of extraordinary magnitude, even up to about 300 bar, in the installation.

FIG. 3 shows the spray head in an inactivated state of rest. Upon the ampoule 20 being released, e.g. by melting or crushing, the spring 22 presses the spindle 21 downwards in the figure, whereat connection is opened from the inlet 16 to the branch outlet 17 and to the obliquely downwards directed nozzles 26 of the spray head. The nozzles 26 are preferably of a structure and in a mutual arrangement as described in the international patent applications PCT/FI92/00155 and PCT/FI92/00156.

When a fire has started in the cabin 1, the spray head 3 is released. The corridor spray head 4 is also activated, due to the branch connection 17-7; as can be seen in FIG. 3, the passage from the connection 17 (7 in FIGS. 1 and 2) to the obliquely downwards directed nozzles 26 of the spray head is open in spite of the ampoule 20 being intact and the connection to the inlet 16 being closed.

The fire in the cabin 1 is mainly extinguished by the cabin spray head 3. The corridor spray head 4 participates in extinguishing the fire and, more important, provides a barring curtain in the door opening. This curtain prevents in a decisive way smoke gases as well as the fire from penetrating into the corridor 2. In addition, as the fire in the cabin sucks in air along the floor, this air brings water-fog from the "curtain" into the cabin and into the fire.

In the embodiment of FIGS. 1 and 2, the corridor spray head 4 also serves the opposite cabin 10. Preferably a group activation according to what has been described in the international patent application PCT/FI92/00316 is employed e.g. in such a way, that extinguishing to at least a lesser extent, for cooling, is initiated also in neighbouring cabins and passages of the corridor. If the corridor 2 is wide, like in hotels, it is recommendable to position a spray head 4 directly outside each door 10.

Figure 4:
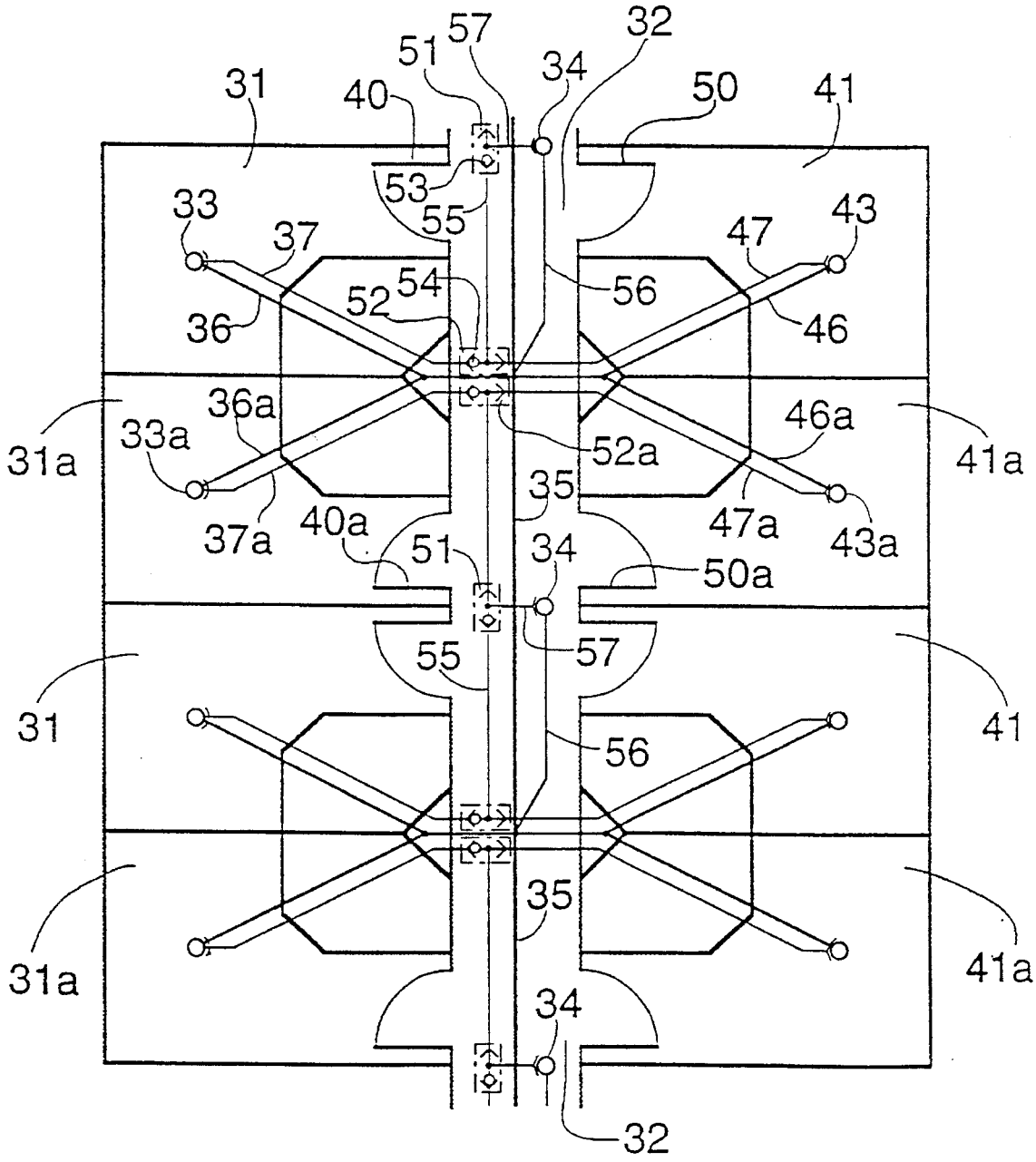
FIG. 4 shows a second preferred embodiment of the invention, in connection with a block of eight cabins seen from above.

FIG. 4 shows a block of eight cabins, four on each side of a corridor. Two cabins to the left of the corridor are indicated by 31, and their neighbouring mirror images by 31*a*. The cabins to the right of the corridor are correspondingly indicated by 41 and 41*a*. The corridor is indicated by 32. Cabin spray heads are indicated by 33, 33*a* and 43,43*a*, respectively, and corridor spray heads are indicated by 34. The cabin spray heads and the corridor spray heads are preferably of the same kind as shown in FIGS. 1, 2 and 3, with interconnecting lines 37, 37*a*, 47, 47*a* and 57, respectively.

A main feed line for extinguishing liquid, running along the corridor 32, is indicated by 35, and branch feed lines to the cabin spray heads are indicated by 36, 36*a* and 46, 46*a*, respectively, and branch feed lines to the corridor spray heads are indicated by 56. Switch check valves in the connections from the cabin spray heads to the corridor spray heads are indicated by 51 and 52, 52*a*, and are e.g. of so-called ball (53, 54) type. In FIG. 4, the valve 52 serves two cabin spray heads 33 and 43 on opposite sides of the corridor 32 and is connected to the valve 51 through a line 55 but is not connected to the adjacent valve 52*a* serving the cabin spray heads 33*a* and 43*a* of the neighbour cabins 31*a* and 41*a*.

If a fire starts in the upper left cabin 31, the spray head 33 is activated and it passes pressurized liquid further through the line 37 to the valve 52, the ball 54 of which is pushed from the position shown in FIG. 4 to the right, closing the connection to the line 47 leading to the cabin spray head 43 in cabin 41, and further through the line 55 to the valve 51, the ball 53 of which is pushed from the position shown in FIG. 4 upwards to open the connection to the corridor spray head 34 via the line 57. The corridor spray head 34 is thus activated by the cabin spray head 33 and produces a curtain barrier of fog-like spray outside the door 40 of the cabin 33 and outside the door 50 of the opposite cabin 41, as well as across the corridor 32 and outside the doors 40*a* and 50*a* of neighbour cabins not shown (upwards) in FIG. 4. Ordinary check valves can be used instead of the ball valves 51, 52. The corridor spray heads 34 are preferably positioned in the middle of the corridor 32, although drawn to the right in FIG. 4.

Figure 5:
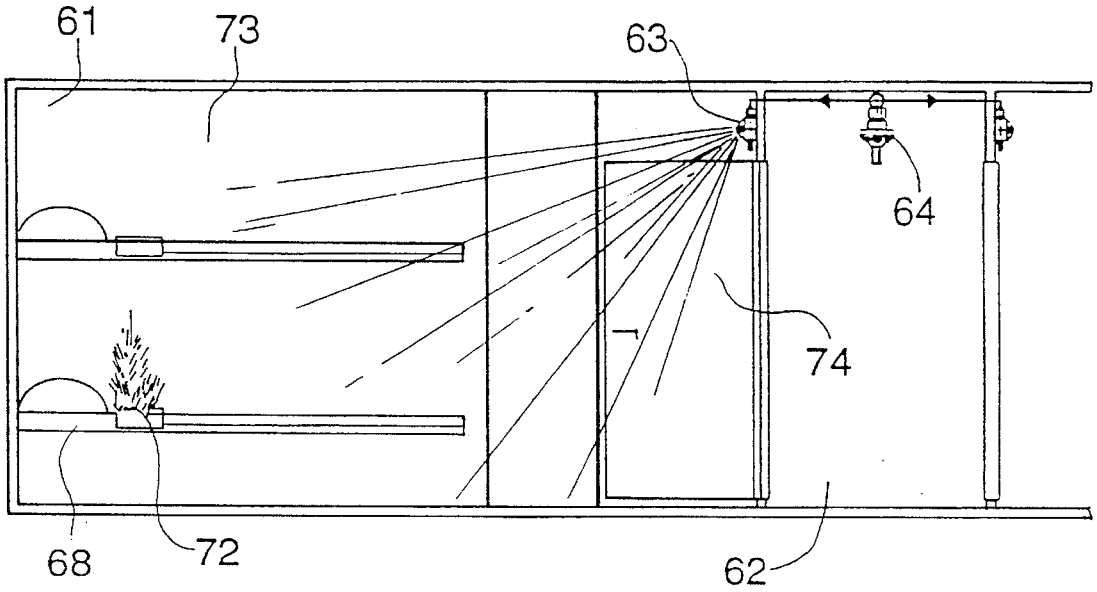
FIGS. 5 and 6 show a third preferred embodiment of the invention, in activated state, in connection with a longitudinal section of a ship cabin and the cabin from above, respectively.
Figure 6:
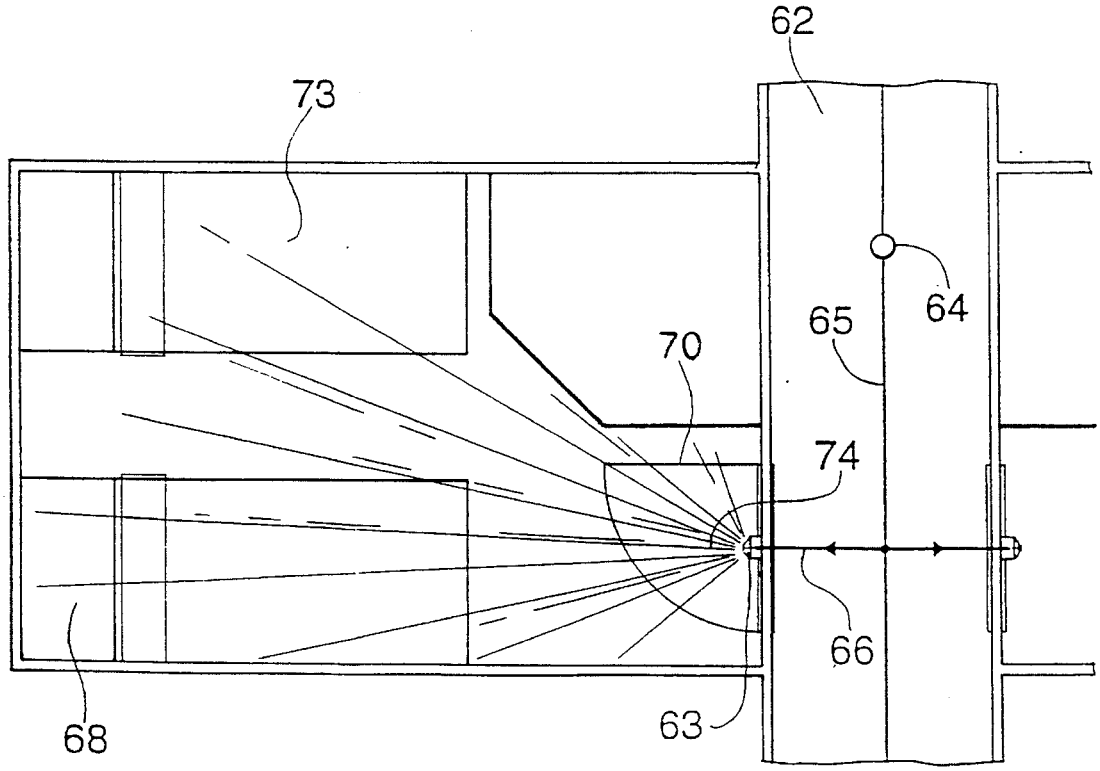

FIGS. 5 and 6 show a further embodiment of the invention. A cabin is indicated by 61, a corridor is indicated by 62, a cabin spray head is indicated by 63 and a spray head in the corridor is indicated by 64. A main feed line for extinguishing liquid is indicated by 65 and a branch feed line therefrom to the cabin spray head 63 is indicated by 66. A lower bed in the cabin 61 is indicated by 68 and the cabin door by 70.

A fire 72 has started in the bed 68 and the cabin spray head 63 has been activated and produces a fog-like spray indicated by grey colour 73. The cabin spray head 63 is positioned on the cabin wall above the door 70 and can have a main spray direction obliquely downwards as indicated in FIG. 5. A curtain-like barrier at the door opening is indicated by dotted lines in darker grey and by numeral 74.

The spray head 63 need not produce the barrier 74 at once. The fire produces a rather strong flow of hot air and smoke along the ceiling towards the spray head and this flow of air and smoke presses the fog-like spray downwards to form the barrier 74. Thus, the main spray direction of the spray head 63 need not necessarily be initially inclined downwards but can be close to horisontal, or even horisontal.

Thanks to its position above the door 70 the single spray head 63 can effectively both reach a fire at the opposite end of the cabin, in a lower bed, which is to be considered as the worst place for a fire to start, and produce a barrier at the door. In addition, the embodiment of FIGS. 5 and 6 is easy to install, which is of significance especially when a fire-fighting installation shall be provided in a previously ready-built ship or hotel.

Figure 7:
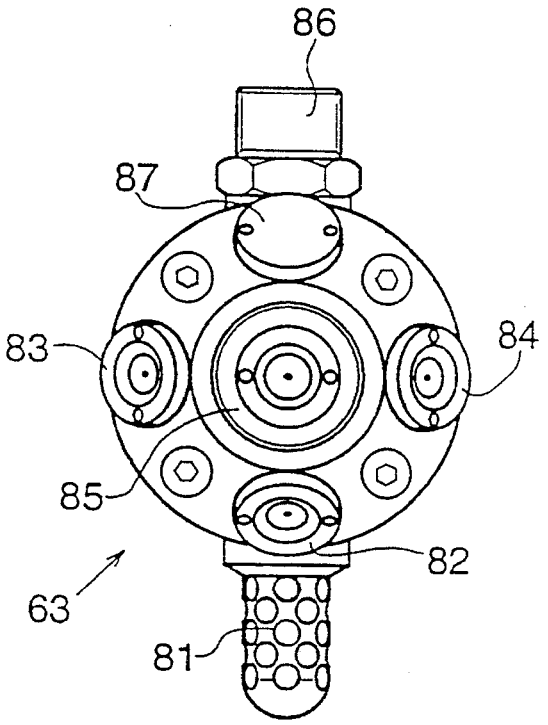
FIG. 7 shows a preferred embodiment of a spray head useful in the arrangement of FIGS. 5 and 6, as seen from the front.
Figure 8:
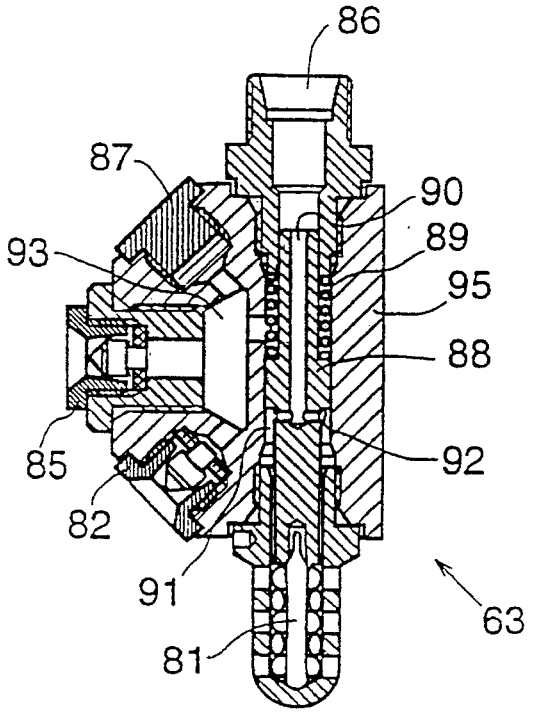
FIGS. 8 and 9 show the spray head of FIG. 7 in longitudinal section, in inactive and activated state, respectively.
Figure 9:
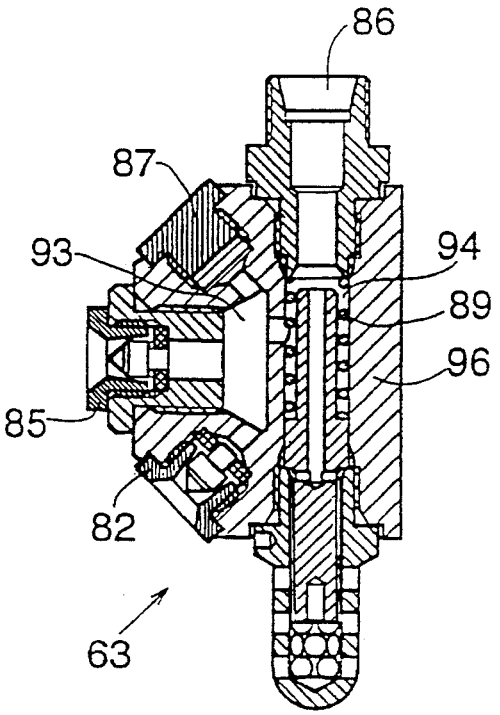

A preferred embodiment of a cabin spray head 63 is shown in more detail in FIGS. 7 to 9. The spray head has a release ampoule or bulb 81, one nozzle 82 directed obliquely downwards, two nozzles 83 and 84 directed obliquely to the sides, in relation to the wall that the spray head is mounted on, and a central nozzle 85 directed straight out from the wall. A liquid inlet is indicated by 86 and a fourth nozzle directed obliquely upwards is closed by a plug 87. By a nozzle arrangement as presented in the international patent applications PCT/FI92/00155 and PCT/FI92/00156 and employing a high operating liquid pressure is achieved a concentrated fog-like spray which, under the influence of the nozzle 82, has a main direction obliquely downwards and is capable of reaching, i.e. penetrating through rising hot air and smoke to a fire seat at a distant corner of a ship cabin or a hotel room. It is of course also possible to mount the spray head on a wall in such a way that the central nozzle 85, and thus the side nozzles 83 and 84, are directed to some extent downwards.

Although it can be considered preferable to arrange the spray head 63 to have its main spray direction inclined at least to some extent downwards, it is not necessary to do so, because, as ealier mentioned, the fire itself tends to press down the spray to produce the desired barrier at the door. Thus, it would be possible to remove the plug 87 and use all nozzles of the spray head. It would further be possible to employ a spray head without a central nozzle.

As will appear from FIGS. 8 and 9, the spray head 63 preferably comprises a spindle structure similar to the one shown in FIG. 3, with an axially movable spindle 88 loaded by a spring 89 against the release ampoule 81 and having an axial channel 90 leading to an annular chamber 91 with an end face 92 which balances the liquid pressure force acting through the inlet 86 on the spindle end; the end face 92 has an area equal to the one of the spindle end at the inlet 86.

In FIG. 8, the spray head is inactive, i.e. the ampoule 81 is intact and there is no connection from the inlet 86 to the nozzles 82–85. In FIG. 9, the ampoule 81 has been broken, the spring 89 has pressed the spindle 88 downwards to make free a connection from the inlet 86 to a side channel leading to a distribution chamber 93 and therefrom to the nozzles 82–85. A major part of the liquid flows to the side channel along a helical path 94 between the slings of the spring 89.

A plate for mounting the spray head on the wall is indicated by 95. The spray head can be mounted in inclined position in relation to the wall e.g. if the plate 95, instead of being of generally even thickness as in FIGS. 8 and 9, has a thicker upper portion.

An essential feature of the invention is the so-called barrier or curtain effect at the door of a ship cabin or a hotel room, or other room. Such barriers can be produced in alternative ways.

In FIGS. 1 and 2 for instance, the single corridor spray head 4 can be replaced by two spray heads, one on each side of the opposite doors, lengthwise in the corridor. One such spray head could be positioned approximately at the point where the branch feed line 6 has been drawn to start from the main feed line 5 and the other approximately in level with the reference numeral 2. If the corridor 2 is wide, a separate spray head 4 can be arranged for each opposite cabin or room door.

A similar modification could be made in the embodiment of FIG. 4, where each corridor spray head 34 alone serves a group of four cabin doors. Instead, the cabin spray heads could be positioned approximately at the pair of switch check valves 52, 52*a* to be activated pairwise to produce barrier curtains in the corridor on both sides of the door of that cabin in which a fire has broken out. Further can be contemplated a group activation of several cabin and corridor spray heads, as presented in the international patent application PCT/FI92/00316, to provide precautionary cooling in the neighbourhood of a fire.

In the embodiment shown in FIGS. 5 and 6, the cabin spray head 63 could be connected to one or several corridor spray heads in the same way as shown in FIGS. 1 and 2. One possibility would be to use the "surplus" nozzle, blocked by the plug 87 in FIGS. 7–9, for such a connection, or to have a wall spray head with a preformed branch connection according to FIGS. 1–3.

I claim:

1. An installation for fighting fire, comprising;

a room having a door;

a first spray head at a first location for spraying a fluid into the room when activated to fight fire in the room;

a second spray head at a second location adjacent the door of the room for spraying a fluid as a barrier of fog-like spray when activated;

a first releasing means in the room for activating the first spray head; and a second releasing means for activating the second spray head, wherein the second release means comprise the first releasing means and a connection line connecting the first and second spray heads for distributing fluid from the first spray head to the second spray head when the first spray head is activated.

2. The installation according to claim 1, wherein the first release means comprise a releasing ampoule.

3. The installation according to claim 1, wherein the second location of the second spray head is outside the room.

4. An installation for fighting fire, comprising:

a ship cabin having a door;

a first spray head at a first location for spraying a fluid into the ship cabin when activated to fight fire in the ship cabin;

a second spray head at a second location adjacent the door of the ship cabin for spraying a fluid as a barrier of fog-like spray when activated;

at least one releasing means in the ship cabin for activating the first and second spray heads; said second spray head being activated when the first spray head is activated, wherein the second location of the second spray head is outside the ship cabin in a middle of a cabin corridor.

5. An installation for fighting fire, comprising:

a room having a door;

a first spray head at a first location for spraying a fluid into the room when activated to fight fire in the room;

a second spray head at a second location adjacent the door of the room for spraying a fluid as a barrier of fog-like spray when activated;

a first releasing means in the room for activating the first spray; and a second releasing means for activating the second spray head, wherein the first location of the first spray head is at an end of the room remote from the door.

6. An installation for fighting fire, comprising:

a first spray head at a first location in a ship cabin for spraying a fluid when activated to fight fire in the cabin;

a second spray head at a second location in a middle of a cabin corridor adjacent a door of the cabin for spraying a fluid as a barrier of fog-like spray when activated; and releasing means in the cabin for activating the first and second spray heads.

* * * * *